United States Patent [19]

Akkerman

[11] Patent Number: 4,582,135

[45] Date of Patent: Apr. 15, 1986

[54] WELL PACKERS

[75] Inventor: Neil H. Akkerman, Houston, Tex.

[73] Assignee: AVA International Corporation, Houston, Tex.

[21] Appl. No.: 467,657

[22] Filed: Feb. 18, 1983

Related U.S. Application Data

[63] Continuation of Ser. No. 346,151, Feb. 8, 1982, abandoned.

[51] Int. Cl.[4] ..... E21B 23/06

[52] U.S. Cl. ..... 166/134; 166/125; 166/182; 166/237

[58] Field of Search ..... 166/123, 125, 182, 212, 166/217, 237, 134, 120

[56] References Cited

U.S. PATENT DOCUMENTS

| | | | |
|---|---|---|---|
| 3,086,589 | 4/1963 | McGowen, Jr. | 166/134 |
| 3,244,233 | 4/1966 | Villalon, Jr. | 166/134 |
| 3,374,837 | 3/1968 | Page et al. | 166/134 |
| 3,552,489 | 1/1971 | Berryman | 166/120 |
| 3,749,166 | 7/1973 | Young | 166/123 |
| 4,071,084 | 1/1978 | Brown | 166/182 |
| 4,289,200 | 9/1981 | Fisher, Jr. | 166/120 |
| 4,375,240 | 3/1983 | Baugh | 166/212 |

*Primary Examiner*—Stephen J. Novosad
*Assistant Examiner*—Hoang C. Dang
*Attorney, Agent, or Firm*—Vaden, Eickenroht, Thompson & Jamison

[57] ABSTRACT

There are disclosed two embodiments of a packer for closing off the annular space between a pipe string and a well bore in which the pipe string is disposed, each of which includes an annular packing element adapted to be expanded into sealing engagement with the well bore in response to relative axial movement between inner and outer tubular members, and releasably latched in expanded position by means which includes a circumferentially expandible and retractable body lock ring. In each case, the body lock ring has cam teeth about its outer side which are engaged with cam teeth on the inner circumference of the outer tubular member for circumferential expansion and contraction with respect thereto, and a relatively long length of ratchet teeth on its inner side for ratcheting with respect to a relatively short length of ratchet teeth on the outer circumference of a latching member carried by the inner tubular member in response to movement of the tubular members to retracted positions.

11 Claims, 13 Drawing Figures

WELL PACKERS

This application is a continuation of my copending application, Ser. No. 346,151, filed Feb. 8, 1982, now abandoned, and entitled "Well Packers."

This invention relates generally to packers for closing off the annular space between a pipe string and a well bore in which the pipe string is disposed. More particularly, it relates to improvements in well packers of this type which are adapted to be releasably latched in sealing position by means which includes a circumferentially expandable and contractible body lock ring.

In packers of this latter type, an annular packing element of rubber or other deformable sealing material is disposed between axially spaced-apart, oppositely facing shoulders about a pair of tubular members which are arranged one within the other for relative axial movement between retracted and extended positions. Thus, upon movement of the members to retracted positions, the packing element is expanded from a normally contracted position spaced from the well bore to an expanded position for sealing between the packer and well bore. As well known in the art, the tubular members may be so moved in a number of ways—e.g., hydraulically, by manipulation of the pipe string, or mechanically by a tool lowered into the pipe string. Also, the packers may be used for a variety of purposes and under various conditions, such as in the drilling, completion or workover of the well.

It has been proposed to latch the tubular members in retracted position, and thus hold the packer "set", by means of a so-called "body lock ring". Thus, cam teeth on one side of the ring are engaged with cam teeth on one tubular member to hold it in a position thereon in which it is free to circumferentially expand and retract as ratchet teeth on a latching member carried by the other tubular member and on the other side of the ring ratchet with respect to one another as the members are retracted. More particularly, the cam teeth are of such configuration as to prevent retrograde movement of the ratchet teeth past one another, and to in fact urge them into tight engagement due to the tendency of the expanded packing element to return the tubular members to extended position.

In order to permit the tubular members to be unlatched for return to extended positions, whereby the packer may be retrieved or otherwise moved within the well bore, packers have been proposed in which a latching member carried by the inner tubular member includes a portion which is circumferentially expandible and retractable with respect to the remainder thereof, and a sleeve is mounted within the latching member for shifting between one position in which it blocks contraction of such portion of the latching member, during retraction of the tubular members, and another position in which it frees such portion for contraction in order to release the tubular members for return to extended position. As shown in U.S. Pat. No. 4,018,274, the expandible and contractible portion of the latching member may comprise collet fingers extending from a continuous ring on the end of the inner tubular member from which the latching member is carried. On the other hand, as shown in U.S. Pat. No. 4,289,200, the expandible and contractible portion may comprise a series of circumferentially spaced segments carried by the remainder of the latching member for radial shifting with respect to the remainder of the latching member.

The sleeve may be moved between its blocking and unblocking position in any suitable manner, such as, for example, in response to manipulation of the pipe string, or mechanically by means of a tool lowered into the packer bore. In any event, the sleeve is normally held in blocking position by means of one or more shear pins connecting it to the latching member.

In the packer of U.S. Pat. No. 4,018,274, as well as in certain embodiments of the packer shown in U.S. Pat. No. 4,289,200, the circumferentially expandible and contractible portion of the latching member is adapted to be held by the sleeve in latching engagement with the body locking ring, and released therefrom upon shifting of the sleeve. In the packer shown in another embodiment of U.S. Pat. No. 4,289,200, means are provided on the circumferentially expandible and contractible portion and the inner tubular member for connecting them for axial movement together, when such portion is expanded, but disconnecting them for relative axial movement when the portion is retracted. More particularly, teeth are formed on a continuous ring of the latching member, and the sleeve is movable within the latching member between one position within expandible and contractible portion to connect the latching member to the other tubular member, and another position removed from within such portion to permit the other tubular member and latching member to be moved axially apart as the tubular members are extended. In each case, of course, release of the tubular members for extension with respect to one another permits the packing element to contract.

In the packer of U.S. Pat. No. 4,018,274, the ratchet teeth are formed on the inner tubular member and the inner side of the lock ring, while, in the packer of U.S. Pat. No. 4,289,200, they are formed on the outer side of the lock ring and the outer tubular member. Although the latter arrangement is alleged to enable certain types of packers to be shorter than that of the packer of U.S. Pat. No. 4,018,274, the lock ring may not be stiff enough to resist the effect of extraneous matter tending to resist its radial expansion and contraction. Also, the relatively fine ratchet teeth on the inner circumference of the outer tubular member are more difficult to inspect than are those on the inner side of the body lock ring of the packer of U.S. Pat. No. 4,018,274. Still further, more difficulty may be encountered in effecting release between the relatively coarse cam teeth, in the case of the packer of U.S. Pat. No. 4,289,200, than between the fine ratchet teeth of the packer of U.S. Pat. No. 4,018,274.

The primary object of this invention is to provide such a packer in which the stroke of the tubular members may be relatively short, but in which one or more and preferably all of the above-mentioned problems are overcome in a relatively simple and inexpensive manner.

This and other objects are accomplished, in accordance with the illustrated embodiments of the invention, by a packer of the type described in which the body lock ring has cam teeth formed on its outer side which are engaged with cam teeth on the inner circumference of the outer tubular member for circumferential expansion and retraction with respect thereto, and a latching member carried by the inner tubular member has a relatively short length of ratchet teeth formed on its outer surface for sliding engagement with a relatively long length of ratchet teeth on the inner side of the lock ring, whereby the tubular members may ratchet past one another in moving to retracted position as the lock ring expands and contracts with respect to the outer tubular member. More particularly, the latching member includes a portion which is circumferentially expandible and contractible with respect to the remainder thereof, and the sleeve is shiftable within the latching member between one position for blocking contraction of such portion, during retraction of the tubular members, and another position freeing such portion of the latching member for contraction in order to release the tubular members for return to extended position.

In one embodiment of the invention, the latching member comprises collet fingers which extend from a continuous ring at the end of the tubular member and which have ratchet teeth formed thereon for engaging those on the body lock ring, and the sleeve, in its one position, is disposed within the collet fingers to prevent their contraction, but, upon shifting to its other position, is removed from within the collet fingers. Release of the tubular members for return to extended position may be effected between the ratchet teeth or between the cam teeth. That is, the lock ring and teeth may be so constructed as to permit the ratchet teeth to move past one another, or, alternatively, the cam teeth on the body lock ring to move past those on the inner circumference of the outer tubular member, as the tubular members are moved to extended position. In another embodiment of the invention, the latching member comprises collect fingers extending from a continuous ring on which the ratchet teeth are formed, with the fingers and the inner tubular member having means which connect them for axial movement together when the fingers are expanded, and disconnecting them for relative axial movement when the fingers are contracted, the sleeve being within the collet fingers in one position to connect the latching member to the inner tubular member, and being removed therefrom, in its other position, to permit the inner tubular member and latching member to be moved axially apart as the tubular members are extended.

In both embodiments of the invention, the sleeve is continuous and slides axially within the collet fingers from its one to its other position. Also, in each embodiment, the sleeve is releasably connected to the latching member in its one position. In the first embodiment, the shear pin releasably connects the sleeve to the collet fingers, and, in the second described embodiment, the shear pin releasably connects the sleeve to the continuous ring of the latching member.

In both embodiments of the invention, a seal ring is carried about the outer circumference of the inner member and near the latching member for sealably sliding over the inner circumference of the other tubular member, and the ratchet teeth on the outer circumference of the latching member are adjacent those on the inner side of the locking ring in the extended position of the tubular members. More particularly, the lock ring is preferably of no greater length than required to permit the ratchet teeth on the latching member to move into latched position with respect thereto, upon expansion of the packing element.

In the drawings, wherein like reference characters are used throughout to designate like parts:

FIGS. 1A and 1B are side views of the upper and lower portions of a packer constructed in accordance with the first described embodiment of the invention, lowered into a well bore and with the tubular members thereof extended with respect to one another to permit the packing element to contract out of engagement with the wellbore, the left side of FIG. 1A being shown in elevation and the right side thereof being shown in vertical cross section, and FIG. 1B being a vertical sectional view of the right side only of the lower portion of the packer;

Figure 9:
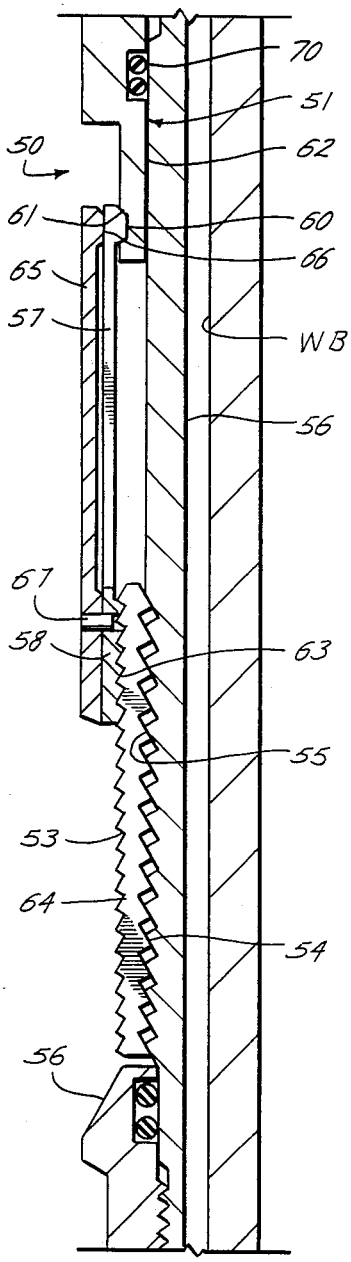
FIG. 9 is a vertical sectional view of a portion of a packer constructed in accordance with the second mentioned embodiment of the present invention, showing the inner and outer tubular members in extended position.
Figure 10:
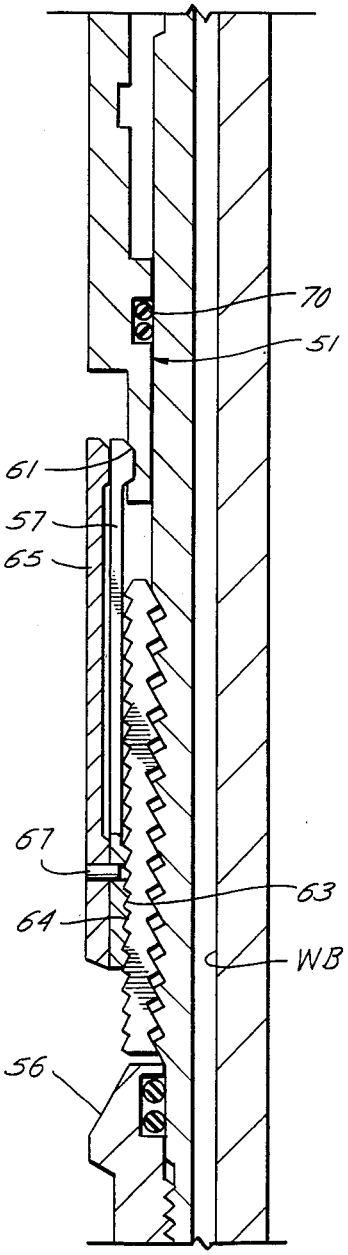
Figure 11:
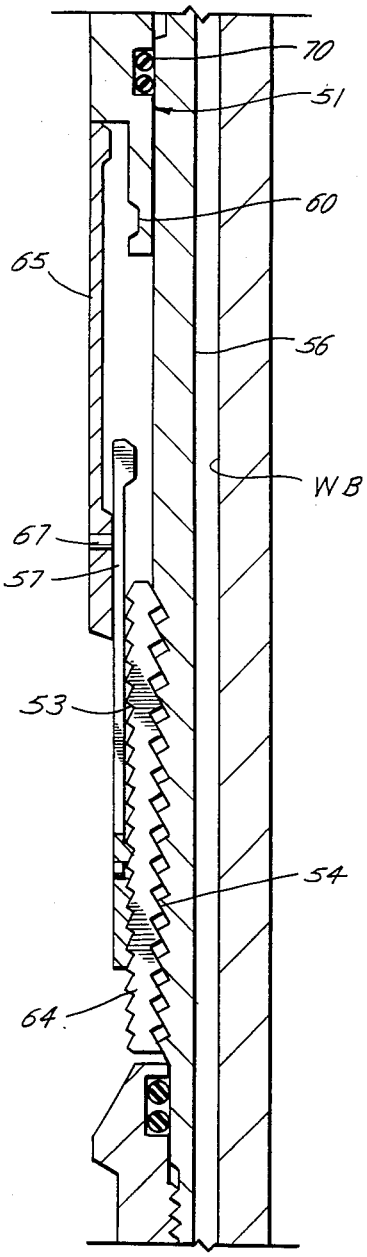

FIG. 10 is another vertical sectional view of the packer, similar to FIG. 9, showing the tubular members releasably latched to one another in retracted position for expanding the packing element thereof (not shown) into set position; and FIG. 11 is another view similar to FIGS. 9 and 10, but upon shifting of the inner sleeve to its upper position to permit the upper end of the latching member and the lower end of the inner tubular member to be disconnected, upon extension of the tubular members with respect to one another, to extended position, in order to permit the packer to contract out of sealing engagement with the well bore.

Figure 1A:
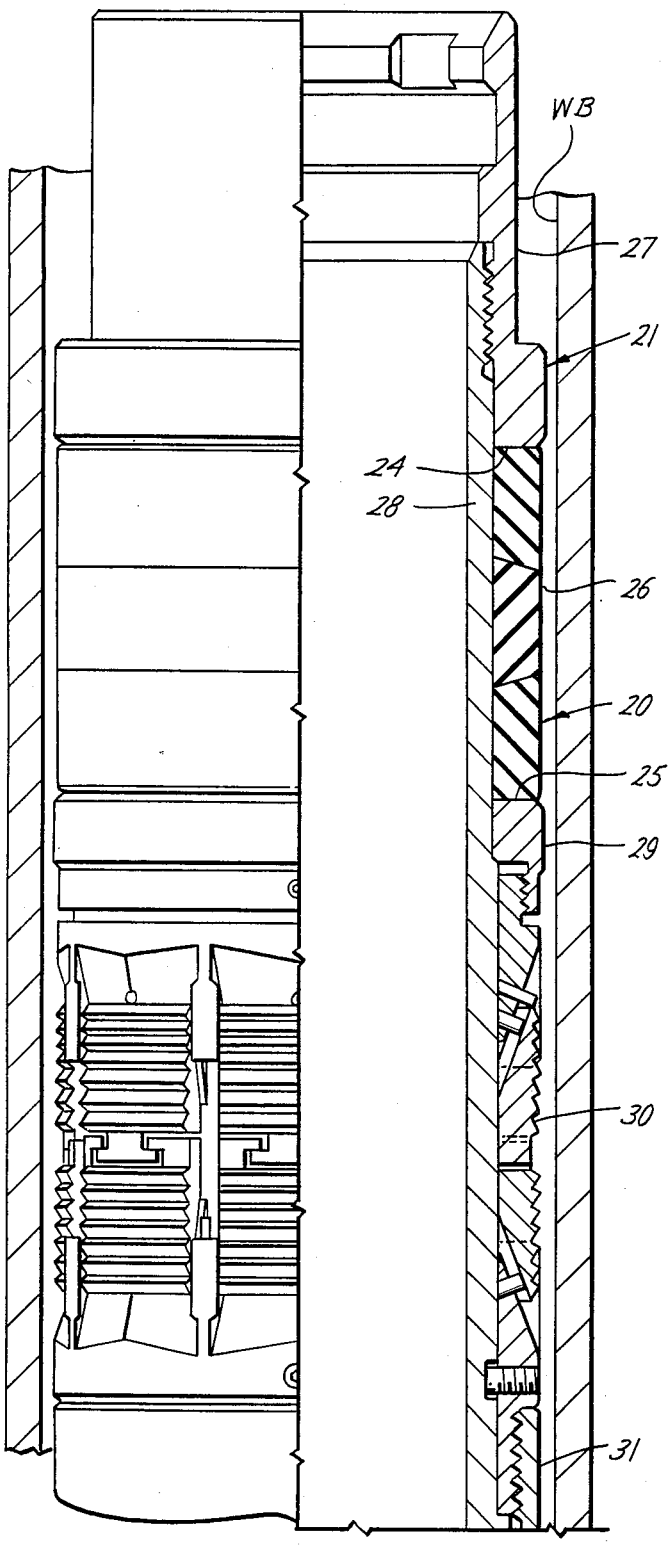
Figure 1B:
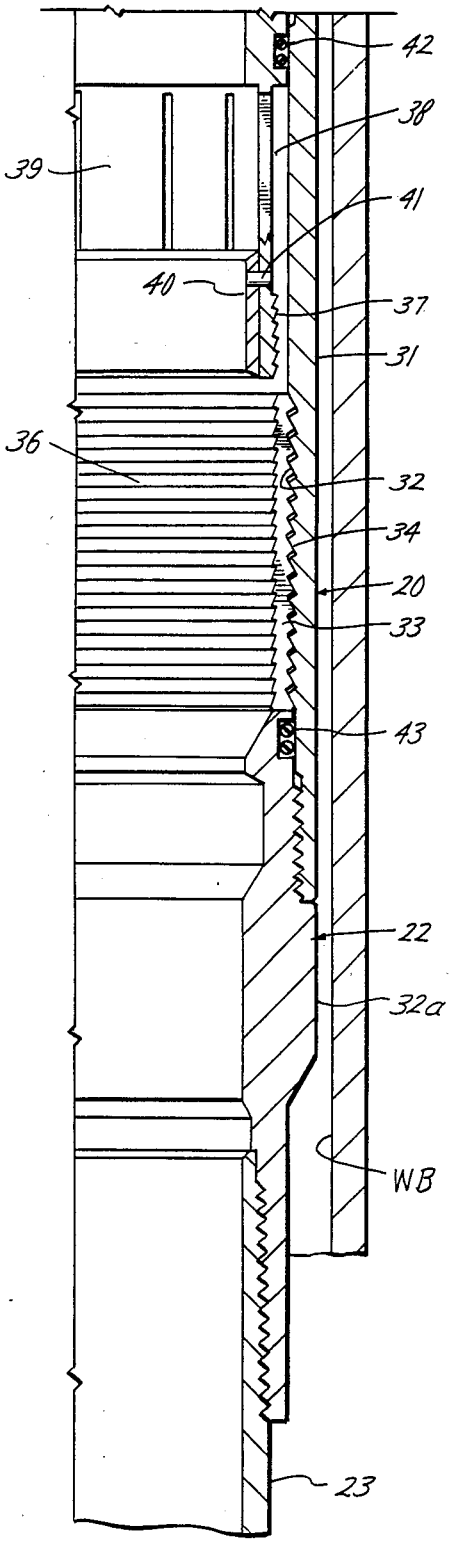
Figure 5A:
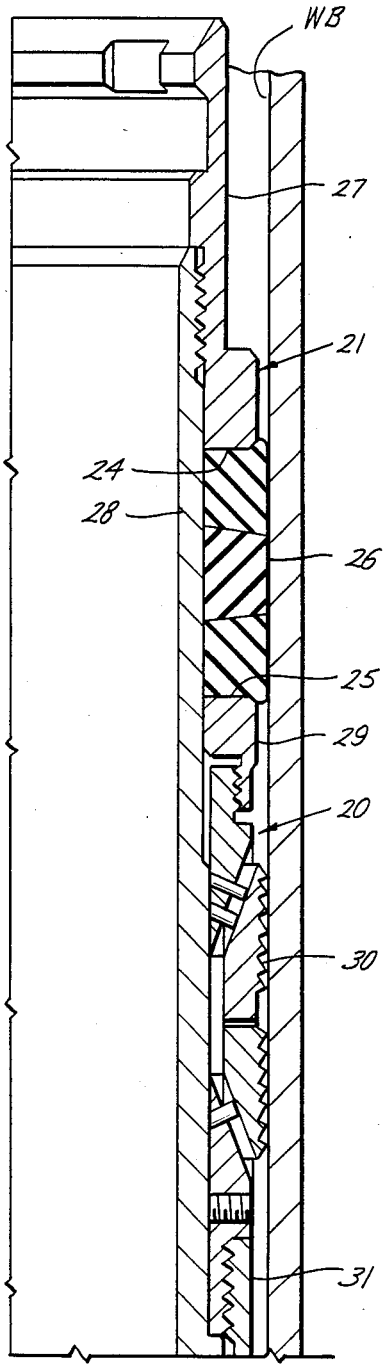
FIGS. 5A and 5B are half vertical sectional views of the right side of the upper and lower portions of the packer of FIGS. 1 to 4, upon retraction of the tubular members so as to expand the packing element into sealing engagement with the well bore.
Figure 5B:
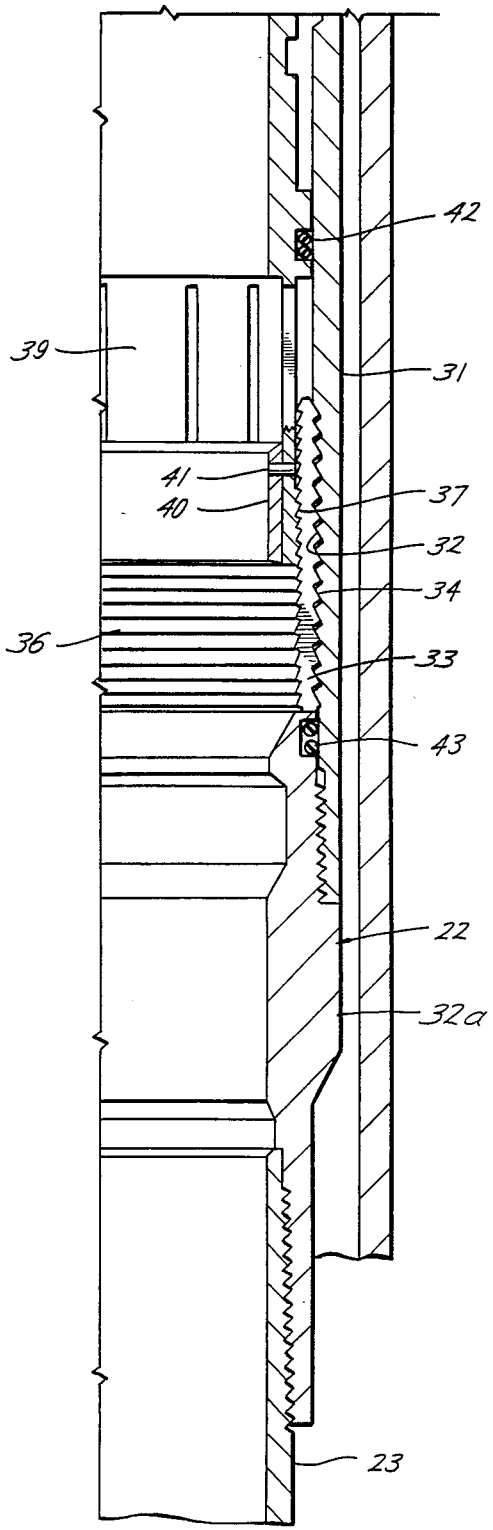

With reference now to the details of the above-described drawings, the first packer embodiment, which is designated in its entirety by reference character 20, and shown in FIGS. 1 to 8 as being disposed within a well bore WB, comprises inner and outer tubular members 21 and 22, respectively, which are arranged coaxially one within the other for relative axial reciprocation between the extended position of FIGS. 1A and 1B and the retracted position of FIGS. 5A and 5B. The upper end of the inner tubular member 21 has means for connection with the lower end of an upper well pipe, and the lower end of the outer tubular member 22 is threaded for connection with lower well pipe 23.

The inner tubular member has a downwardly facing shoulder 24 thereabout, which is spaced above an upwardly facing shoulder 25 about the outer tubular member, and a packing element 26 of rubber or other deformable sealing material is contracted about the inner tubular member intermediate the shoulders 24 and 25.

With the tubular members extended, as shown in FIGS. 1A and 1B, the outer circumference of the packing element is spaced from the well bore, so as not to interfere therewith as the packer is lowered into or raised from the well bore. However, upon retraction of the tubular members so as to move the shoulders 24 and 25 toward one another, as shown in FIGS. 5A and 5B, the packing element is expanded radially outwardly into sealing engagement with the well bore. As it will be more fully understood from the description to follow, the terms "inner" and "outer" have reference to the relationship of the tubular members to the lock ring to be described. Thus, for example, in an alternative construction, the inner tubular member may connect with a well pipe at the lower end of the packer, and the outer tubular member may connect with the well pipe at the upper end of the packer.

As shown, the inner tubular member is made up of a nut 27 having pipe connecting means at its upper end and the shoulder 24 formed on its lower end, and a pipe 28 connected to and depending from the nut to receive the packing element 26 thereabout. The outer tubular member 22, on the other hand, includes a nut 29 whose upper end forms the shoulder 25, and a slip assembly 30 connected to and suspended from the nut 29. As shown, and as known in the art, the slip assembly includes upper and lower cones supporting upper and lower sets of slips for sliding between the retracted positions of FIG. 1, in which they are spaced from the well bore WB, and the expanded positions of FIGS. 5A and 5B in which they are expanded into gripping engagement with the well bore. The lower cone of the slip assembly is connected to a pipe 31 which in turn is connected to a sub 32 at its lower end (see FIG. 1B) having the threads by which the lower end of the packer is connected to the lower well pipe.

The inner circumference of the pipe 31 of the outer tubular member is provided with cam teeth 32 just above the connection of its lower end to the sub 32, and a body lock ring 33 is mounted within the outer tubular member by means of cam teeth 34 about its outer side which are engaged with those of the outer tubular member. More particularly, the body lock ring is of a length at least substantially equal to that of the length of the cam teeth on the inner tubular member, and the lower end of the body lock ring is seated upon the upper end of the sub 32. The cam teeth may comprise threads which permit the body lock ring to be threaded into the position shown within the inner tubular member prior to connection of sub 32 to the pipe 31.

Figure 2:
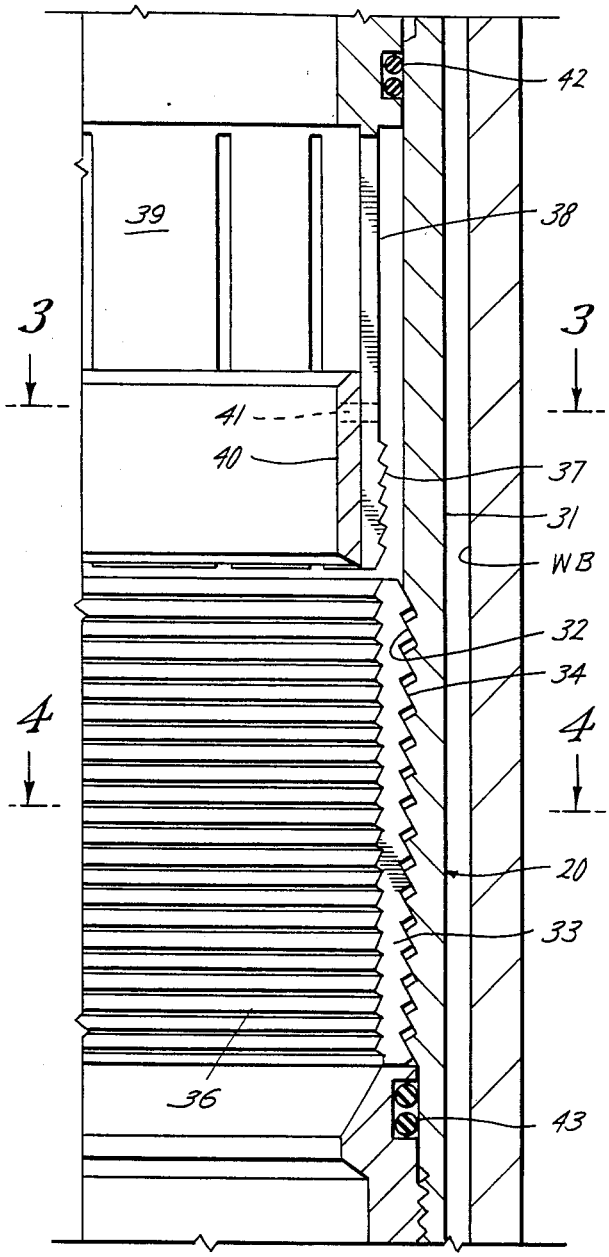
FIG. 2 is an enlarged vertical sectional view of the packer of FIG. 1B, but showing only the latching member on the lower end of the inner tubular member adjacent the upper end of the lock ring.
Figure 3:
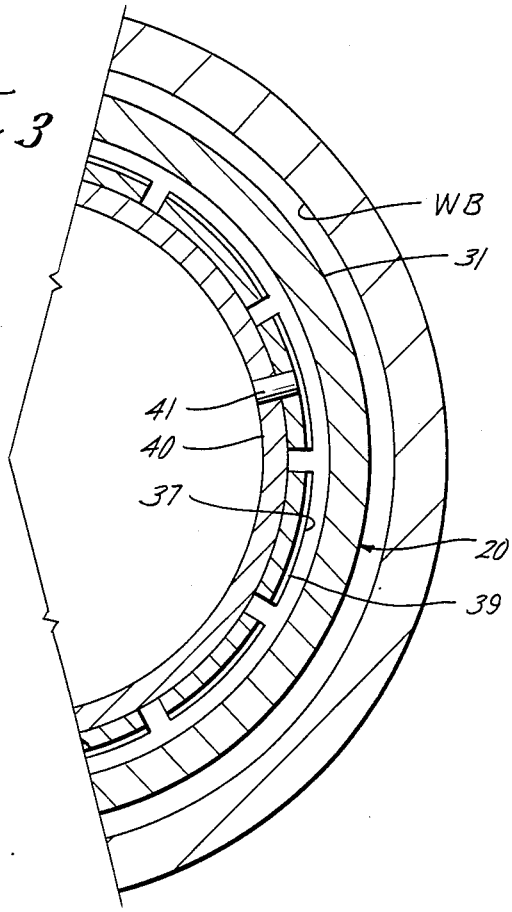
FIG. 3 is a partial cross-sectional view of the packer, as shown along broken lines 3—3 of FIG. 2.
Figure 4:
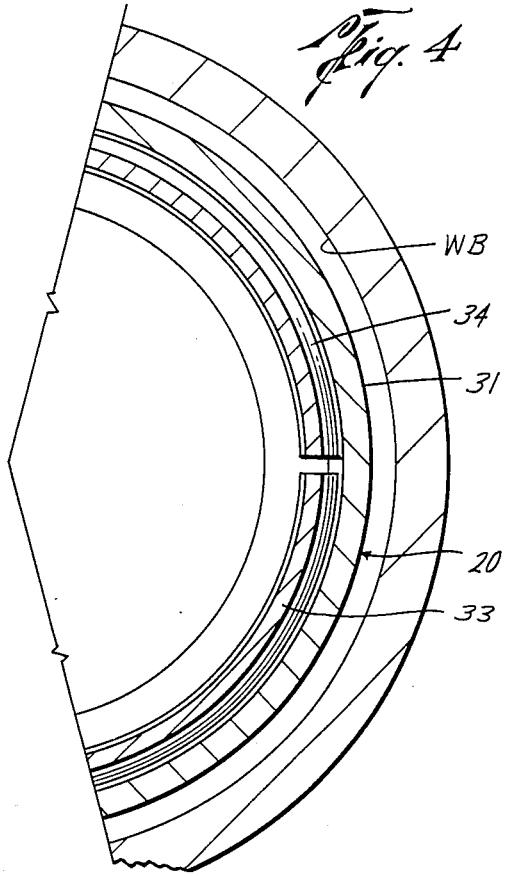
FIG. 4 is a partial cross-sectional view of the packer as shown along broken lines 4—4 of FIG. 2.
Figure 6:
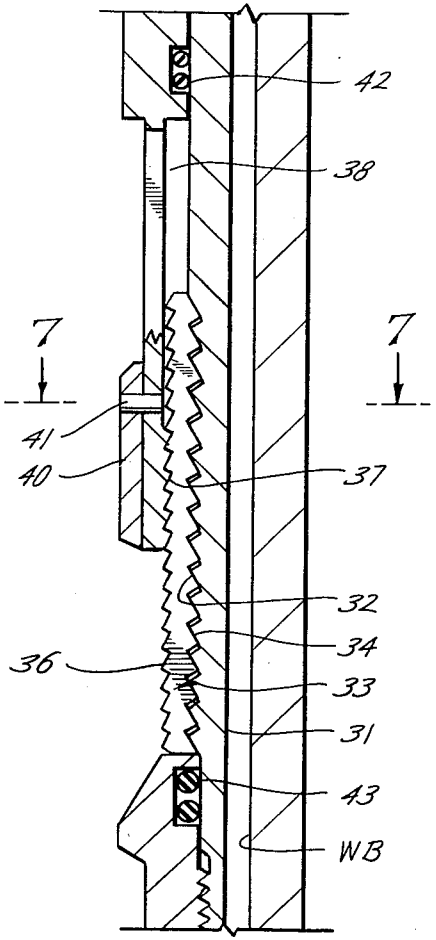
FIG. 6 is an enlarged vertical sectional view of the packer of FIG. 5B, but showing only the lower end of the latching member adjacent the upper end of the body lock ring.

As best shown in FIG. 6, body lock ring is circumferentially discontinuous and of such construction as to assume the shape of FIG. 2 when unstressed whereby the cam teeth permit it to expand out of and contact back into such shape. More particularly, and as will also be understood from the drawings, the cam teeth on the inner circumference of the outer tubular member are of such construction as to permit those on the body lock ring to slide downwardly therealong as the ring is expanded circumferentially and then upwardly therealong as it is contracted.

With the lock ring contracted, ratchet teeth 36 formed along the inner side of the body lock ring are in position to be engaged by ratchet teeth 37 on the outer circumference of a latching member 38 carried by the lower end of the inner tubular member 21. Thus, as the tubular members are moved to retracted positions, the ratchet teeth will ratchet over one another as the body lock ring expands and contracts due to the engagement of its cam teeth with those of the inner circumference of the outer tubular member. More particularly, the ratchet teeth will continue to ratchet over one another until the tubular members have been retracted to a position to expand the packing element into sealing engagement with the well bore and the slip teeth 30 into gripping engagement with the well bore. Depending on the tolerances involved, this may require that the ratchet teeth on the latching member move substantially the full length of the ratchet teeth on the body lock ring. Alternatively, it may require substantially less movement, as illustrated for example in FIG. 6.

In the embodiment of the invention illustrated in FIGS. 1 to 8, the latching member 38 comprises a plurality of collet fingers 39 depending from the lower continuous ring of the pipe 28 of the inner tubular member 21. More particularly, the collet fingers are of such length as to permit the lower end thereof on which the ratchet teeth 37 are formed to be contracted sufficiently to permit retrograde movement of teeth 37 past the ratchet teeth 36 formed on the body lock ring so as to release the tubular members for extension with respect to one another in a manner to be described. Alternatively, since the top sides of the cam teeth 34 are steeper than the bottom sides of ratchet teeth 36, the cam teeth may instead be caused to release before the ratchet teeth if the gap between the split ends of the body lock ring is made greater than the circumferential contraction required to move the peaks of cam teeth 34 past those of cam teeth 32 on the outer tubular member.

Figure 8:
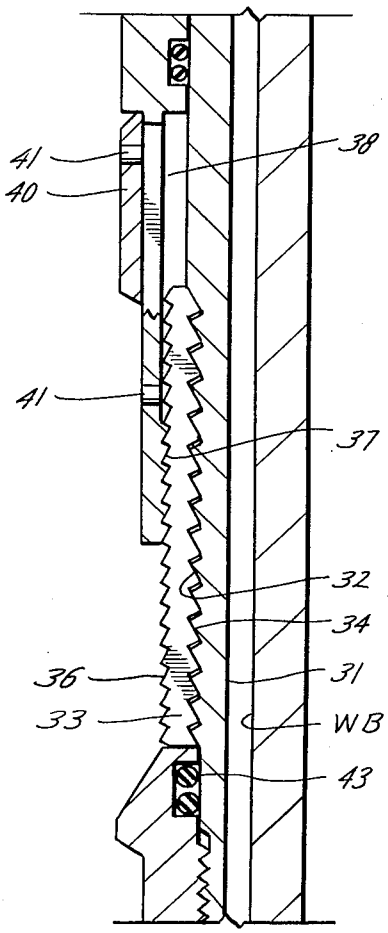
FIG. 8 is another vertical sectional view of the packer shown in FIG. 5B, but upon shifting of the inner sleeve to its upper unblocking position in order to unlatch the tubular members for movement to extended positions.
Figure 7:
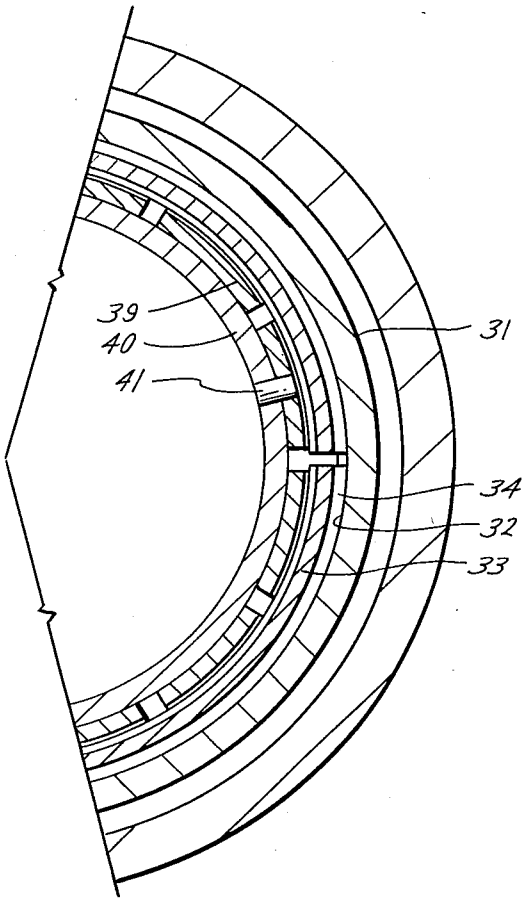
FIG. 7 is a partial cross-sectional view of the packer as seen along broken lines 7—7 of FIG. 6.

During retraction of the tubular members, however, and thus ratcheting of teeth 37 over teeth 36, the teeth 36 are prevented from contracting by means of a sleeve 40 which is disposed within the inner circumference of the lower end of the collet fingers, and retained in such position by means of one or more shear pins 41. When it is then desired to release the packer so that it may be retrieved from the well bore, sleeve 40 is moved upwardly to the position shown in FIG. 8, wherein it permits the lower ends of the collet fingers, and thus the ratchet teeth 37 formed thereon, to move over the ratchet teeth 36 on the inner side of the body lock ring, or alternatively, cam teeth 34 to move over cam teeth 32, as the tubular members are moved toward extended position. When shifted to its upper position, the sleeve will engage at its upper end with the lower end of a shoulder about the solid ring at the lower end of the inner tubular member, as shown in FIG. 8.

In the embodiment shown, the tubular members are adapted to be moved from extended to retracted positions by means of a tool (not shown) adapted to be lowered into the bore of the inner tubular member. More particularly, and as well known in the art, a tool of this type is provided with dogs for engagement with shoulders on the upper end of the inner tubular member and lower end of the outer tubular member, whereby, upon retraction of the tool, the tubular members are moved to retracted position. Sleeve 40 may likewise be moved from its blocking position of FIG. 6 to its unblocking position of FIG. 8 by means of a suitable tool lowered into the bore of the inner tubular member and having a dog or other suitable means for engaging the lower end of the sleeve 40 in order to apply upward force thereto sufficient to shear the pin 41 and lift the sleeve.

The inner and outer tubular members are sealed with respect to one another by O-rings 42 carried about the outer circumference of the inner tubular member for sealably sliding along the inner circumference of the outer tubular member. As shown, the O-rings are received within a groove about the outer circumference of the lower end of the inner tubular member just above the upper end of the latching member depending therefrom, so that, when the tubular members are in their retracted positions, the O-rings are located near the upper end of the body lock ring. As shown, additional rings 43 are carried by the sub 32 of the outer tubular member for sealably engaging with the lower end of pipe 31 of the upper tubular member to complete the sealed connection of the members with respect to one another.

Except for the portions thereof shown in FIGS. 9 to 11, the second embodiment of the present invention may be of identical construction to that described above in connection with FIGS. 1 to 8. Thus, this packer, which is indicated in its entirety by reference character 50, comprises an inner tubular member 51 having an upper end (not shown) adapted to be connected to an upper pipe, and an outer tubular member 52 which is coaxial with respect to the upper inner tubular member and axially reciprocal with respect thereto, and which has a lower end (not shown) for connection with the lower pipe. As in the case with the first described packer, packer 50 is adapted to be lowered into a well bore WB whereby a packing element and slips mounted thereon may be set in the manner described in connection with FIGS. 1 to 8.

The embodiment of FIGS. 9 to 11 also has a body lock ring 53 which is identical to the body lock ring of FIGS. 1 to 8 both from the standpoint of its construction and the manner in which it is mounted within the outer tubular member. Thus, as shown in FIGS. 9 to 11, cam teeth 54 about the outer side of the body lock ring are engaged with cam teeth 55 formed on the inner circumference of the outer tubular member to mount the body lock ring near the far end of the well pipe 56 of the outer tubular member which connects with the radially reduced portion of the sub 56 at the lower end of the outer tubular member.

As compared with the embodiment of FIGS. 1 to 8, however, the latching member 57 of the embodiment of FIGS. 9 to 11 comprises collet fingers 58 which are connected to or joined by a continuous ring 58 at their lower ends and releasably connected at their upper ends to the lower end of inner tubular member 51. Thus, the upper ends of the collet fingers are provided with dogs 60 adapted to fit within a groove 61 about a depending enlarged inner diameter portion 62 on the lower end of the inner tubular member. More particularly, the collet fingers are of such length as to permit them to contract out of the locked position shown in FIGS. 9 and 10, and the lower ends of the dogs and the groove have cam surfaces so that the dogs are forced out of the groove in response to relative axial movement of the inner member with respect to the outer tubular member, and thus with respect to the latching member.

Ratchet teeth 63 are formed about the continuous ring 59 of the latching member for engagement with ratchet teeth 64 formed on the inner side of body lock ring 53. Thus, as in the embodiment of FIGS. 1 to 8, when the tubular members are moved to retracted positions, the ratchet teeth on the latching member are moved into latching engagement with the ratchet teeth of the body lock ring to expand the packing element and slips into set positions.

Since ratchet teeth 63 are formed on the continuous ring 59 of the latching member, they will remain in latching engagement with the body lock ring when moved to the position of FIG. 10. A sleeve 65 within latching member 57 has an annular surface 66 at its upper end which is disposed within the upper ends of the collet fingers opposite the locking dogs 60 so as to prevent contraction of the locking dogs out of connected position with respect to the inner tubular member as the latching member is moved downwardly to the position of FIG. 10. The sleeve 65 extends downwardly to dispose its lower end about the solid ring 59 of the latching member, and one or more shear pins 67 releasably connect the sleeve to the latching member with its surface 66 in blocking position during the ratcheting operation.

When the packer has been set, and with the latching member and sleeve in the position shown in FIG. 10, a suitable tool may be lowered into the well bore to engage with the lower end of the sleeve 65 and apply an upward force thereto in order to shear the pin 67 and move the sleeve upwardly to the position of FIG. 11 so as to remove surface 66 from within the dogs 60. In this way, the dogs are free to be cammed out of connection with the lower end of the inner tubular member, whereby the tubular member may be raised relatively to the outer tubular member so as to release the packing element and the anchoring slips and thus permit retrieval of the packer. As shown, when the sleeve 65 is raised, as described, its upper end moves into the radially enlarged lower end 62 of the inner tubular member.

Seal rings 70 are carried by the outer circumference of the lower end of the inner tubular member for sealably engaging the inner circumference of the outer tubular member, and in this respect the embodiment of FIGS. 9 to 11 is similar to that of FIGS. 1 to 8. However, as compared with the embodiment of FIGS. 1 to 8, in the extended position of the tubular members, the ratchet teeth 63 on the latching member 57, although also adjacent to the ratchet teeth at the upper end of the body lock ring, as in the case of FIGS. 1 to 8, are actually engaged therewith, rather than spaced just thereabove.

As shown in both embodiments of the invention, the ratchet teeth on the latching members are of relatively short length, preferably comprising the minimum number of teeth necessary to contain the energy of the expanded packing element. On the other hand, the ratchet teeth on the lock ring are of relatively long length, comprising, in addition to the minimum number of teeth, a sufficient number to accommodate the maximum anticipated stroke of the tubular members from extended to retracted positions.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A packer adapted to be installed within a well bore, comprising a pair of tubular members arranged one within the other for relative axial movement between retracted and extended positions, an annular packing element of deformable sealing material disposed between axially spaced-apart, oppositely facing shoulders about the members for radial expansion into sealing engagement between the pipe string and packer as the members are moved to retracted position, and means for releasably latching the packing element in expanded position, including a lock ring having cam teeth on its outer side engaged with cam teeth on the inner circumference of the outer member for circumferential expansion and contraction with respect thereto, a latching member carried by the inner tubular member and having ratchet teeth on its outer surface slidably engageable with ratchet teeth on the inner side of the lock ring, the longitudinal extent of the ratchet teeth on the inner side of the lock ring being of greater length than the longitudinal extent of the ratchet teeth on the outer surface of the latching member to permit relative axial movement of the tubular members to retracted position as the lock ring expands and contracts with respect to the other tubular member, said latching member including a portion which is circumferentially expandable and contractible with respect to the remainder thereof, and a sleeve shiftable within the latching member from one position for blocking contraction of said portion thereof, during retraction of the tubular members, and to another position freeing said portion of the latching member for contraction in order to release the tubular members for return to extended position.

2. A packer of the character defined in claim 1, wherein the latching member comprises collet fingers extending from a continuous ring on the end of the inner tubular member, said ratchet teeth on the latching member are formed on the collet fingers for engaging those on the lock ring, and said sleeve is within the collet fingers to prevent their contraction, in its one position, but removed from within said fingers, upon shifting to its other position, so that the engaged teeth on one side of the lock ring are free to move over one another as the tubular members are moved to expanded position.

3. A packer of the character defined in claim 2, wherein ratchet teeth move over one another to release the latching member from the lock ring.

4. A packer of the character defined in claim 2, wherein the cam teeth move over one another to release the lock ring from the outer tubular member.

5. A packer of the character defined in claim 2, wherein the sleeve is continuous and slides axially within the collet fingers from its one position to its other position.

6. A packer of the character defined in claim 5, including a shear pin releasably connecting the sleeve to the collet fingers in its one position.

7. A packer of the character defined in claim 1, wherein a seal ring is carried about the outer circumference of the inner tubular member and near the latching member for sealably sliding over the inner circumference of the other tubular member, and the ratchet teeth on the outer circumference of the latching member are adjacent those on the inner side of the locking ring in the extended position of the tubular members.

8. A packer of the character defined in claim 1, wherein the latching member comprises collet fingers extending from a continuous ring, said fingers and said inner tubular member have means thereon to connect them for axial movement together when the fingers are expanded, and disconnect them for relative axial movement when the fingers are retracted, the ratchet teeth on the latching member are formed on the continuous ring thereof, and the sleeve is within the collet fingers to maintain the latching member connected to the inner tubular member, in its one position, and removed from within said fingers, in the other position, to permit the inner tubular member and latching member to be moved axially apart as the tubular members are extended.

9. A packer of the character defined in claim 8, wherein the sleeve is continuous and slides axially within the collet fingers from its one position to its other position.

10. A packer of the character defined in claim 9, wherein a shear pin releasably connects the sleeve to the ring of the latching member.

11. A packer of the character defined in claim 8, wherein a seal ring is carried about the outer circumference of the inner tubular member and near the latching member for sealably sliding over the inner circumference of the other tubular member, and the ratchet teeth on the outer circumference of the latching member are adjacent those on the inner side of the locking ring in the extended position of the tubular members.

* * * * *